US005091149A

United States Patent [19]

Shin et al.

[11] Patent Number: 5,091,149

[45] Date of Patent: Feb. 25, 1992

[54] MANUFACTURING METHOD OF ALUMINUM-LITHIUM ALLOY BY ATMOSPHERIC MELTING

[75] Inventors: Myung C. Shin; Keun Y. Sohn; Young H. Chung, all of Seoul; Young Y. Lee; Tai W. Park, both of Daejeon, all of Rep. of Korea

[73] Assignee: Korea Institute of Science & Technology, Seoul, Rep. of Korea

[21] Appl. No.: 673,146

[22] Filed: Mar. 21, 1991

[30] Foreign Application Priority Data

Jun. 16, 1990 [KR] Rep. of Korea ..... 8873/1990

[51] Int. Cl.[5] ..... C22C 1/00; C22C 21/00

[52] U.S. Cl. ..... 420/528; 75/686; 420/590

[58] Field of Search ..... 75/408, 412, 680, 686; 420/528, 590; 266/207

[56] References Cited

U.S. PATENT DOCUMENTS 4,761,266 8/1988 Bruski ..... 420/528

*Primary Examiner*—Richard O. Dean
*Assistant Examiner*—Robert R. Koehler
*Attorney, Agent, or Firm*—Darby & Darby

[57] ABSTRACT

A manufacturing method of aluminum-lithium alloy by atmospheric melting in which oxidation of lithium is minimized through improvement of degassing system under normal atmospheric melting method without using separate hermetically sealing device for isolating from atmosphere upon melting of alloy material.

The method is carried out in that aluminum and other alloy elements except metal lithium are melted in atmosphere, and primary degassing process is executed in a state that surface of the molten metal is covered with a flux such as LiCl or LiF, and then metal lithium ingot covered with aluminum is added to molten metal and secondary degassing process is executed with bubbling inert gas and thereafter tertiary degassing process is executed by flowing inert gas such as argon through hermetically sealed pouring path of molten metal.

3 Claims, 1 Drawing Sheet

MANUFACTURING METHOD OF ALUMINUM-LITHIUM ALLOY BY ATMOSPHERIC MELTING

BACKGROUND OF THE INVENTION

The present invention relates to a manufacturing method of aluminum-lithium alloy by atmospheric melting, and more particularly, to a manufacturing method of aluminum-lithium alloy by atmospheric melting in which oxidation of lithium is minimized through improvement of degassing system under general atmospheric melting method without using a separate hermetical sealing device for isolation of atmosphere upon melting alloy material so that good ingot without internal defect can be manufactured economically.

Metal lithium (Li) has 0.53 g/cm$^3$ in its specific weight and so it is lightest among metals and very much excellent in ductility, on the contrary chemical activity is much large and accordingly it has not so much applicable value as a lithium metal alone. However, in case when it is added to aluminum whereby becoming to aluminum-lithium alloy, it serves not only for greatly improving strength of aluminum but also for considerably decreasing weight of aluminum alloy itself.

Particularly, aluminum-lithium alloy has characteristic that density is low but strength is high and elasticity is high, accordingly it is expected not only for application as super-light weighted structural material including aviation and space industry field but also application for various industrial fields requiring above-mentioned characteristics.

Explaining this in more detail, in case when high strength aluminum alloy for aircraft structure generally used at present is substituted by aluminum-lithium alloy, weight reducing of about 7–9% is possible and accordingly not only increase of flying speed and flying range of aircraft but also improvement of transporting ability can be planned. And, in case of protecting capability of equal level to existing aluminum armored material requiring high strength and high hardness, manufacturing of lighter structural material of about 10% is possible and accordingly it is expected for applicability as elementary material for armored plate material or missile field.

However, according to the aluminum-lithium alloy, different from normal aluminum alloy obtained through atmospheric melting, lithium is very much larger in oxidation ability in atmosphere and therefore, since melting process of alloy material should be executed within inert ambient environment isolated from atmosphere, there is disadvantage that great expense for installation of hermetic sealing device is required.

In addition, since aluminum-lithium alloy is extraordinarily high in hydrogen containing rate relative to the existing aluminum alloy group, in case when sufficient degassing process is not executed in melting process of alloy, pin hole and pore are produced within the ingot whereby material characteristic is spoiled and accordingly there is problem that manufacturing of good ingot is not easy, and therefore it is generally known that aluminum lithium group is almost difficult to manufacture by normal atmospheric melting and casting method.

Therefore, existing aluminum-lithium alloy is manufactured in a form for executing entire melting and casting process within hermetically sealed container maintained with inert ambient environment, and as an example of such alloy manufacturing technique under hermetically sealed ambient environment, a method is described in U.S. Pat. No. 4,556,535 in which molten aluminum and molten lithium are continuously fed into hermetically sealed mixing tank fed with mixture gas of argon Ar and chlorine $Cl_2$ and then mixed therein and then said aluminum-lithium mixture molten liquid is poured through filter into an ingot casting device so that ingot of aluminum-lithium alloy is manufactured.

However, according to such hermetically sealed type alloy manufacturing method, entire melting and casting processes from melting alloy material and mixing tank to ingot casting device should be maintained in inert gas ambient environment of isolated state from atmosphere, and separate control unit for adding quantity control of lithium is required, and therefore there is problem that enormous planting expense is required and handling is complicated.

SUMMARY OF THE INVENTION

Therefore, it is an object of the present invention, in manufacturing the aluminum-lithium alloy through general atmospheric melting method with excluding the use of hermetically sealing device for maintaining inert ambient environment that conventional manufacturing method of aluminum-lithium alloy includes, to provide a manufacturing method of aluminum-lithium alloy by atmospheric melting in which oxidation of lithium is minimized in melting and casting process and also degassing process through three times is executed whereby internal defect generation of ingot is suppressed so that good aluminum-lithium alloy ingot is economically manufactured.

Particularly, according to the present invention, as a way for preventing that recovering rate of lithium is dropped due to oxidation through contact with atmosphere of metal lithium which is greatest problem upon atmospheric melting of aluminum-lithium alloy, lithium covered with pure aluminum as metal lithium to be added to molten metal of aluminum alloy is used.

Above-described aluminum covered lithium ingot is manufactured through a "manufacturing method of aluminum-lithium alloy" of Korean patent application No. 89-953 which was filed on Jan. 28, 1989 by the applicant of this application, and this method is a form in which solid phase lithium is extruded by utilizing extruder in atmosphere and then extruded out lithium is directly filled and hermetically sealed into aluminum container, wherein according to the covering method of lithium by such an extruding method, there is advantage that planting expense is less and oxidation rate of lithium upon covering is low.

On the other hand, aluminum-lithium alloy is several times higher in hydrogen containing rate relative to other aluminum alloy, in case when pertinent molten metal control is not accompanied in melting process, pores are produced much in casting, resulting in deterioration of material characteristic, thereby manufacturing of good ingot becomes difficult.

Therefore, according to the present invention, ingot is manufactured in a state that surface of molten metal is covered with flux upon melting of alloy material whereby contact with atmosphere is prevented and simultaneously in casting process after degassing process, contact of atmosphere with molten metal is minimized.

DETAILED DESCRIPTION OF THE INVENTION

Hereinafter, the manufacturing method of aluminum-lithium alloy of the present invention will be described in detail with reference to the accompanying drawings.

Firstly, aluminum and other alloy materials except metal lithium are melted in atmosphere by using graphite crucible 1, and then surface of molten metal 2 is covered with flux 3 of LiCl or LiF and the like whereby the surface of molten metal is isolated from atmosphere so that oxidation and hydrogen absorption of the molten metal 2 are prevented.

At this moment, hydrogen gas either absorbed from filled material or absorbed a little from atmosphere is contained within the aluminum alloy molten metal and this hydrogen gas forms hydride upon addition of metal lithium in post-process and thereby possibility for decreasing recovery rate of lithium and deteriorating material characteristic are great, therefore primary degassing process of molten metal is executed by using normally used degassing agent before adding metal lithium to aluminum molten metal.

Next, after the primary degassing process, lithium ingot covered with aluminum is instantaneously inserted into molten metal by utilizing graphite plunger to thereby be molten.

Since there is possibility to be mixed with hydrogen into the molten metal of aluminum-lithium alloy upon adding of metal lithium, a gas bubbler 4 is buried into the molten metal whereby inert gas of high purity is blown into the molten metal and thereby secondary degassing process is executed.

Figure 1:
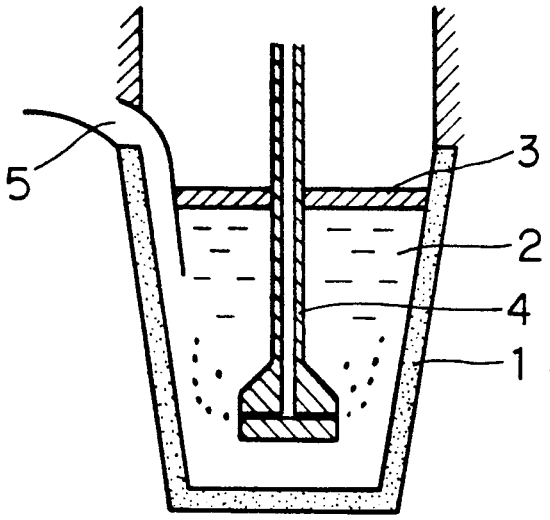
FIG. 1 is a cross sectional view showing an example of an apparatus used for degassing of molten metal according to the present invention.
Figure 2:
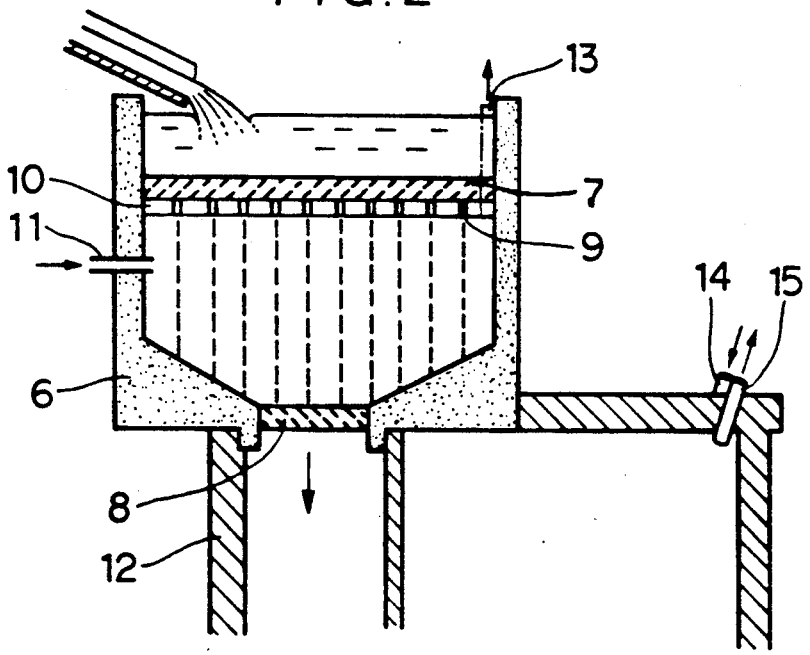
FIG. 2 is a schematic cross sectional view showing an example of casting device used for a preferred embodiment of the present invention.

The molten metal finished with secondary degassing process is poured instantly through molten metal outlet 5 into a tundish 6 as a casting device, at this moment, the tundish 6 is, as shown in FIG. 2, provided with a graphite panel 10 provided respectively with upper and lower ceramic filters 7, 8 at the upper portion and bottom portion within the interior thereof and including a number of flowing grooves 9 at the bottom of upper ceramic filter 7.

And, inert gas inlet 11 is formed at a side wall of the tundish 6 through which inert gas such as argon gas is introduced into the interior of space surrounded by interior wall of tundish 6 and the upper and lower ceramic filters 7, 8 to thereby be maintained in an inert environment, so that molten metal passing through the ceramic filter 7 and graphite panel 10 and flowing to the lower portion becomes executed with tertiary degassing process.

On the other hand, the molten metal which has been executed the tertiary degassing process is poured through the lower ceramic filter 8 into casting mold 12 provided at its bottom, at this moment, said casting mold 12 is maintained in a hermetically sealed state isolated from atmosphere in order to prevent producing of oxide and mixing of hydrogen gas, and its interior is formed with inert gas environment. In the drawings, reference numeral 13 is gas flowing outlet, and numerals 14 and 15 are respectively gas inlet and outlet.

While the ingot of aluminum-lithium alloy according to the present invention is obtained through aforementioned series of atmospheric melting and casting processes, in addition to the above-described method, inert gas such as argon gas is flowed above the molten metal of graphite crucible whereby oxidation of molten metal is further decreased and thereby recovery rate of lithium can also be improved.

And, melting temperature within the graphite crucible is desirable at range of 750°–830° C., and flowing speed and flowing period of time of inert gas (argon) used upon secondary degassing are pertinent to maintain respectively about 1–5 l/min and 4–10 minutes, and the graphite panel within the tundish does not so much effect for the material characteristic of ingot even though the pouring is executed with excluding this graphite panel.

Thus, according to the present invention, oxidation of lithium is minimized by adopting covered lithium with aluminum as a lithium raw material, and besides containing hydrogen within the molten metal is eliminated through covering of molten metal with flux as well as degassing processes over several times and simultaneously producing of oxide is suppressed, and therefore there is effect that good aluminum-lithium alloy without internal defect can be economically manufactured.

Hereinafter, an example according to the present invention will be described.

Example

Aiming 2090 aluminum-lithium alloy composition (Al-2.2 Li-2.9 Cu - 0.15 Zn - 0.13 Zr), aluminum-lithium alloy of approximately 20 kg was melted by using low purity graphite crucible at tilting type kerosene furnace utilizing oil burner. At this moment, commercial aluminum of purity 99.7% was used for aluminum ingot metal, and high purity of 99.9% was used for lithium. And, other alloy elements were filled in the form of supplementary alloy such as Al-50Cu, Al-30Zn, and Al-5Zr.

For melting, firstly aluminum and other alloy elements except metal lithium were melted in atmosphere and then the molten metal surface was covered with flux of LiCl and thereafter primary degassing process was executed by utilizing commercial degassing agent. Next, lithium ingot of 50 mm in diameter and 100 mm in length covered with aluminum was inserted into the molten metal by the extruding method by utilizing graphite plunger to melt and then argon gas was blown into the molten metal for 6 minutes at a flowing speed of 2 l/min and thereby secondary degassing process was executed. And next, the molten metal finished with secondary degassing process was poured into casting device and simultaneously tertiary degassing process was executed, at this moment, pouring temperature of the molten liquid was 820° C., and metal mold was used by preheating at about 150° C.

Thus, an ingot of 163 mm in diameter and 306 mm in length was manufactured, and this ingot was executed equilibrating process and then extruded in a plate material form of 100 mm in width and 12 mm in thickness, and as a result of executing ingredient analysis, recovery rate of metal lithium was 93–95%, and therefore it could be known that very high value was shown.

When the result executed with tensile strength after above-described extruded plate material obtained through a method of the present invention was executed with aging process T85, is exhibited by comparing with alloy manufactured with maintaining entire processes in inert ambient environment by Alcoa corporation of U.S.A., it will be as following table 1.

TABLE 1

| | Aging process condition | Tensile strength (MPa) | Yield strength (MPa) | Malleable rate (%) | Density (g/cm$^3$) |
|---|---|---|---|---|---|
| Alloy of the Present Invention | T85 | 580 | 539 | 6.0 | 2.59 |
| Alloy 2090 | T85 | 569 | 530 | 7.9 | 2.59 |

What is claimed is:

1. A method for manufacturing aluminum-lithium alloy by atmospheric melting, wherein:

aluminum and other alloy materials except metal lithium are melted within atmospheric and in a state that surface of said molten metal is covered with a flux, a primary degassing process is executed by utilizing generally used degassing agent and then;

molten metal of aluminum-lithium alloy is manufactured by adding metal lithium covered with aluminum and sucessively;

secondary degassing process of molten metal is executed by burying gas bubbler into the molten metal and blowing inert gas therein; and then in a process for pouring the molten metal into casting mold maintained with inert ambient environment, tertiary degassing process is executed by flowing inert gas to hermetically sealed pouring liquid path of hermetically sealed molten metal so that ingot of good aluminum-lithium alloy is manufactured.

2. The method as claimed in claim 1, wherein said flux is LiCl or LiF.

3. The method as claimed in claim 1, wherein said secondary degassing process is executed by introducing argon gas through a gas bubbler at a speed of 1–5 l/min for 4–10 minutes.

* * * * *